United States Patent [19]

Santoro

[11] Patent Number: 4,782,950

[45] Date of Patent: Nov. 8, 1988

[54] DECORATIVE FIGURE ARTICLE HOLDER

[76] Inventor: Catherine J. Santoro, 852 Beaconsfield, Grosse Pointe Park, Mich. 48230

[21] Appl. No.: 570,700

[22] Filed: Jan. 16, 1984

[51] Int. Cl.[4] ..... B65D 73/00

[52] U.S. Cl. ..... 206/457; 229/8; 446/73; 446/268

[58] Field of Search ..... 206/423, 457; 229/8, 229/66; 446/73, 77, 227, 268; 5/434, 440, 442, 489, 491, 492, 508; D21/166, 167, 189; D6/201, 202, 203

[56] References Cited

U.S. PATENT DOCUMENTS

| | | | |
|---|---|---|---|
| D. 249,286 | 9/1978 | O'Connor | D34/4 R |
| 1,361,628 | 12/1920 | Shailer . | |
| 1,520,346 | 12/1924 | Harris et al. . | |
| 1,719,256 | 7/1929 | Bernstein . | |
| 2,102,077 | 12/1937 | Kahn | 229/8 |
| 2,129,654 | 9/1938 | Dennis | 150/52 |
| 2,180,340 | 11/1939 | Eisler | 446/268 |
| 2,234,739 | 3/1941 | Murrell | 446/73 |
| 2,704,903 | 3/1955 | Laughlin | 229/8 |
| 2,897,863 | 8/1959 | Somers, Jr. | 383/66 |
| 3,099,568 | 7/1963 | Brody et al. | 229/8 |
| 3,863,283 | 2/1975 | Mohr | 5/442 |
| 3,992,811 | 11/1976 | Yellin | 206/423 |
| 4,125,212 | 11/1978 | Courchesne | 383/66 |
| 4,319,424 | 3/1982 | Goldfarb et al. | 46/12 |
| 4,335,817 | 6/1982 | Bahr | 383/66 |
| 4,420,903 | 12/1983 | Ritter et al. | 206/423 |

FOREIGN PATENT DOCUMENTS

| | | | |
|---|---|---|---|
| 496028 | 9/1953 | Canada | 5/434 |

*Primary Examiner*—David T. Fidei
*Attorney, Agent, or Firm*—Basile Hanlon

[57] ABSTRACT

A decorative figure article holder includes a support member housed within a hollow container. A cavity is formed in a portion of the container adjacent to the support member. An aperture communicates with the cavity to enable the removable insertion of articles into the cavity. A decorative figure is removably mounted in the support member and includes a garment which covers substantially all of the exterior of the container.

8 Claims, 1 Drawing Sheet

DECORATIVE FIGURE ARTICLE HOLDER

BACKGROUND OF THE INVENTION

1. Field of the Invention:

This invention relates, in general, to article holders and, more specifically, to article holders in the form of a decorative figure.

2. Description of the Prior Art:

Article holders in the form of a decorative figure, such as a doll, etc., have long been used for removably storing various articles. Such article holders are generally constructed in the shape of a figure and include a closable opening for removably inserting articles to the interior of the article holder. Other article holders are formed with a figure mounted on an upper, removable cover which encloses a hollow container or box.

Such article holders find widespread use in storing sleepwear, such as pajamas, nightgowns, etc., on or near the bed when not in use. The article holders can be disposed directly on the bed or hung from a convenient support.

It is an object of this invention to provide the unique article holder designed for removably receiving articles, such as sleepwear. It is also an object of this invention to provide an article holder for storing articles which may be disposed directly on a bed. It is also an object of this invention to provide an article holder which includes a decorative figure, such as a doll. Finally, it is an object of the present invention to provide an article holder in which the decorative figure covers substantially all of the hollow, article receiving container.

SUMMARY OF THE INVENTION

The present invention is an article holder which includes a decorative figure support member housed within a hollow container. The support member fills a portion of the hollow container such that a cavity is formed at one end of the container adjacent to the support member. An aperture formed in the container communicates with the cavity to enable removable insertion of articles into the cavity.

A decorative figure, such as a doll, is removably mounted in the support member. Preferably, the doll includes a long garment, such as a dress, which covers the complete exterior of the container thereby hiding it from view. The garment may be lifted to provide access to the cavity within the container. The decorative figure, which preferably is a doll, may be provided with any desired form and in any race or ethnic persuasion. Thus, the decorative figure article holder of the present invention will appeal to many different children.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
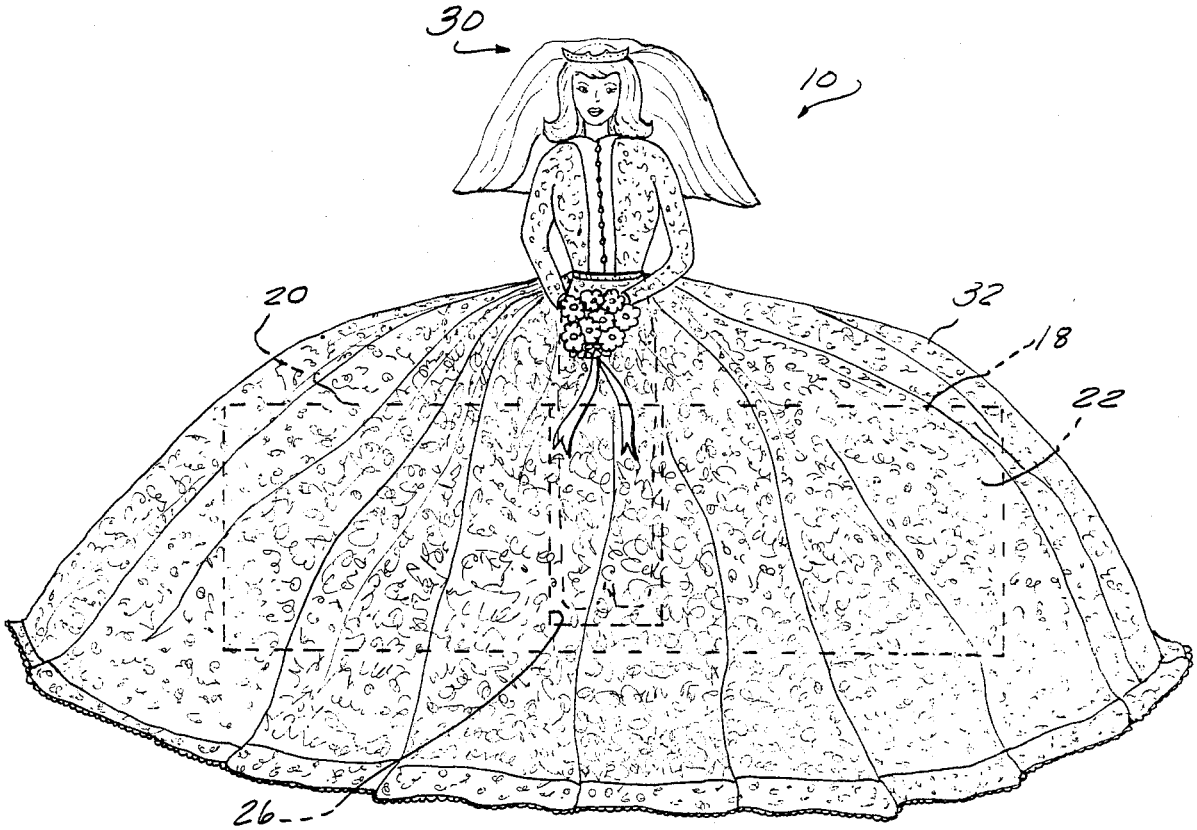
FIG. 1 is a perspective view of the decorative figure article holder of the present invention.

Throughout the following description and drawing, an identical reference number is used to refer to the same component shown in multiple figures of the drawing.

Figure 2:
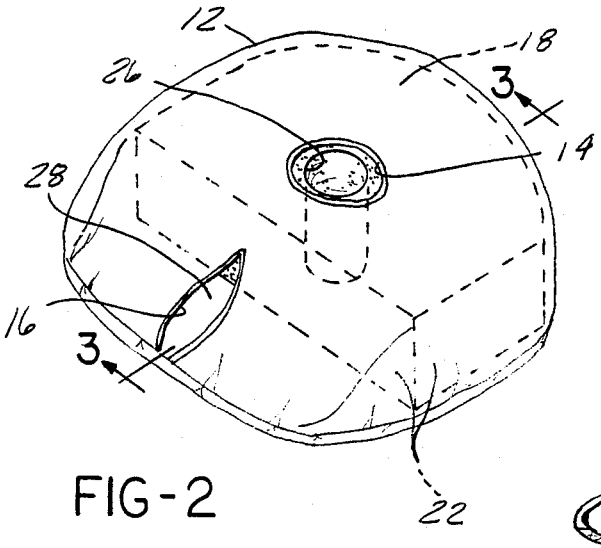
FIG. 2 is a perspective of the container portion of the article holder of the present invention.
Figure 3:
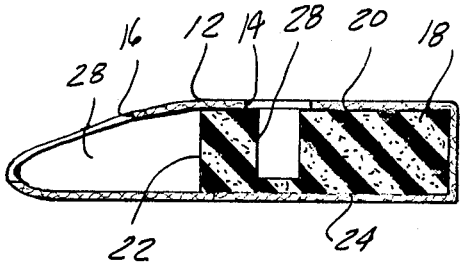
FIG. 3 is a cross-sectional view generally taken along line 3—3 in FIG. 2.

Referring now to FIGS. 1, 2 and 3 of the drawing, there is illustrated a decorative figure article holder 10 constructed in accordance with the teachings of the present invention. The article holder 10 is constructed for removably receiving articles. Preferably, the articles, not shown, comprise sleepwear, such as pajamas, nightgowns, etc. The article holder 10 of the present invention is also designed to be placed directly on a bed to provide a convenient storage for the sleepwear when the sleepwear is not being used.

The article holder 10 includes a hollow container 12. The container 12 is preferably formed of a flexible material, such as fabric, cloth, etc. Seams, not shown, may be formed in the cloth or fabric to form a box-like container for receiving articles.

A first aperture 14 is formed in the top surface of the container 12. Preferably, the aperture 14 is circular in configuration. A second aperture 16 is also formed in the top surface of the container 12. As shown in FIG. 2, the second aperture 16 is in the form of an elongated slot which provides communication to the interior of the container 12. While the second aperture 16 is illustrated in an open configuration, it will be understood that releasable fasteners, such as a zipper, a Velcro-type fastener, etc., may be employed to releasably close the second aperture 16.

The article holder 10 also includes a decorative figure support means 18 which is housed within the hollow container 12. The support means or member 18 is in the form of a solid block having a top surface 20, side walls 22 and a bottom 24. Preferably, one of the side walls 22 has an arcuate or curved configuration as shown in FIG. 2.

The support member 18 is preferably formed of a resilient material, such as foam rubber, etc. Also, a bore 26 is formed within the support member 18 and extends from the top surface 20 partially through the support member 18. The bore 26 removably receives a decorative figure 30, as described in greater detail hereafter. The bore 26 is aligned with the first aperture 14 in the container 12.

The support member 18 has an overall size less than the volume of the container 12 so as to define a hollow cavity or receptacle 28 within the interior of the container 12. The cavity or receptacle 28 communicates with the second aperture 16 to enable removable insertion of articles, such as sleepwear, through the aperture 16 into the cavity or receptacle 28. Thus, such articles are removably stored within the interior of the container 12.

As described above, a decorative figure 30 is removably mounted within the support member 18 with an upper portion extending outward above the support member 18 and container 12. The decorative figure 30 may comprise any figurine, doll, etc. Preferably, however, a female doll is employed. The figure 30 may be configured with any shape, size, race or ethnic persuasion. Thus, for example, the figure 30 may be designed to have Caucasion, Negro, Oriental, Hispanic or American Indian features. The figure 30 may be formed of any suitable material, such as plastic, porcelain, etc.

Since only a portion of the figure 30 is received within the support member 18, only the upper portion or torso of a figure, such as a doll, need have the desired doll-like features. While the legs and lower portion of a complete figure or doll may be mounted within the bore 26 of the support member 18, the lower portion of the figure 30 may also be configured as a post having a configuration complementary to the shape of the bore 26 in the support member 18. In this manner, the figure 30 is securely mounted within the support member 18.

The figure 30 is provided with an outer garment 32. In the case of a doll, the outer garment 32 can be a long dress. The garment 32 thus covers substantially all of the exterior surface of the container 12 when the figure 30 is mounted in the support member 18. This hides the container 12 from view but still enables access to the cavity or receptacle 28 within the container 12 since the garment can merely be raised for the removable insertion of articles, such as sleepwear, through the aperture 16.

In summary, there has been disclosed an unique decorative figure article holder which is adapted for the removable storage of articles, such as sleepwear. The article holder includes support means for removably supporting a figure or doll. The figure is preferably provided with a long garment, such as a dress, which covers the exterior of the container thereby hiding the container from view but still enabling access to the cavity within the container for the removable insertion of articles therein.

What is claimed is:

1. An article holder comprising:

a hollow container;

a first aperture formed in the container;

means, disposed within the container, for supporting a decorative figure;

decorative figure means insertable through the first aperture in the container and mountable within the decorative figure supporting means; the decorative figure extending partially outward from the container through the first aperture;

a hollow cavity formed within the container adjacent to the supporting means; and a second aperture formed in the container in communication with the hollow cavity in the container, the second aperture allowing access to the hollow cavity when the decorative figure means is mounted in the decorative figure supporting means.

2. The article holder of claim 1 wherein the decorative figure means covers substantially all of the exterior of the container when the decorative figure means is mounted in the decorative figure supporting means.

3. The article holder of claim 1 wherein the decorative figure supporting means comprises:

a block member having a bore for receiving the decorative figure means.

4. The article holder of claim 3 wherein the block member is formed of a resilient material.

5. The article holder of claim 1 wherein the container is formed of a flexible material.

6. The article holder of claim 1 wherein the decorative figure means is a doll.

7. The article holder of claim 6 wherein the doll includes a garment which cover substantially all of the container.

8. A decorative figure article holder comprising:

a hollow container;

a first aperture formed in the container;

a decorative figure support member disposed within a portion of the container, the support member being formed of a resilient material;

a decorative figure being insertable through the first aperture in the container and mountable within the decorative figure support member, the decorative figure extending partially outward from the container through the first aperture and having an outer garment which covers substantially all of the exterior of the container when the decorative figure is inserted in the decorative figure support member;

a second aperture formed in the container; and a hollow cavity formed within a portion of the container adjacent to the supporting means in communication with the second aperture;

the second aperture allowing access to the hollow cavity in the container when the decorative figure is mounted in the decorative figure support member.

* * * * *